US009130308B2

(12) United States Patent
Wang et al.

(10) Patent No.: US 9,130,308 B2
(45) Date of Patent: Sep. 8, 2015

(54) LOCKING APPARATUS FOR ELECTRICAL PLUG-TYPE CONNECTORS

(75) Inventors: Yingtao Wang, Guangdong (CN); Junmin Guo, Guangdong (CN)

(73) Assignee: HARTING ELECTRONICS GMBH, Espelkamp (DE)

( * ) Notice: Subject to any disclaimer, the term of this patent is extended or adjusted under 35 U.S.C. 154(b) by 15 days.

(21) Appl. No.: 14/131,509

(22) PCT Filed: Aug. 16, 2011

(86) PCT No.: PCT/CN2011/078442

§ 371 (c)(1), (2), (4) Date: Jan. 8, 2014

(87) PCT Pub. No.: WO2013/023356

PCT Pub. Date: Feb. 21, 2013

(65) Prior Publication Data

US 2014/0134898 A1 May 15, 2014

(51) Int. Cl.

*H01R 13/627* (2006.01)
*H01R 13/635* (2006.01)
*H01R 13/512* (2006.01)

(52) U.S. Cl.

CPC ..... *H01R 13/627* (2013.01); *H01R 13/6275* (2013.01); *H01R 13/635* (2013.01); *H01R 13/512* (2013.01)

(58) Field of Classification Search

CPC ..... H01R 43/16; H01R 13/6272
USPC ..... 439/352
See application file for complete search history.

(56) References Cited

U.S. PATENT DOCUMENTS

| | | | | |
|---|---|---|---|---|
| 6,434,015 | B1 | 8/2002 | Hwang | |
| 7,008,253 | B2 | 3/2006 | Szczesny | |
| 7,114,980 | B1 * | 10/2006 | Wu | 439/352 |
| 7,699,641 | B2 | 4/2010 | Bright et al. | |
| 2005/0084215 | A1 | 4/2005 | Grzegorzewska et al. | |
| 2006/0063415 | A1 | 3/2006 | de Vanssay et al. | |
| 2006/0134985 | A1 | 6/2006 | Reed et al. | |
| 2007/0243749 | A1 * | 10/2007 | Wu | 439/352 |
| 2008/0090456 | A1 | 4/2008 | Bernat et al. | |
| 2009/0209125 | A1 * | 8/2009 | Bright et al. | 439/352 |

FOREIGN PATENT DOCUMENTS

| | | |
|---|---|---|
| CN | 1707868 | 12/2005 |
| CN | 100486050 | 5/2009 |

(Continued)

*Primary Examiner* — Abdullah Riyami
*Assistant Examiner* — Nelson R Burgos-Guntin
(74) *Attorney, Agent, or Firm* — Jacobson Holman, PLLC.

(57) ABSTRACT

The invention proposes an electrical plug-type connector for making contact with a mating plug-type connector, said plug-type connector having a displaceable locking and unlocking apparatus, which exerts a constant pressure on the apparatus by means of a double-sided torsion spring in such a way that the plug-type connector is forcibly locked when contact is made between said plug-type connector and the mating plug. In this case, the pressure exerted by the torsion spring legs is transferred to two axially displaceable sliding posts, which are again part of the unlocking apparatus. Furthermore, the unlocking apparatus has two sliding arms, which can be displaced in a tongue-and-groove guide, at least in regions, within corresponding recesses and flush with respect to the side faces of the plug-type connector housing.

4 Claims, 3 Drawing Sheets

(56) References Cited

FOREIGN PATENT DOCUMENTS

Figure 1:
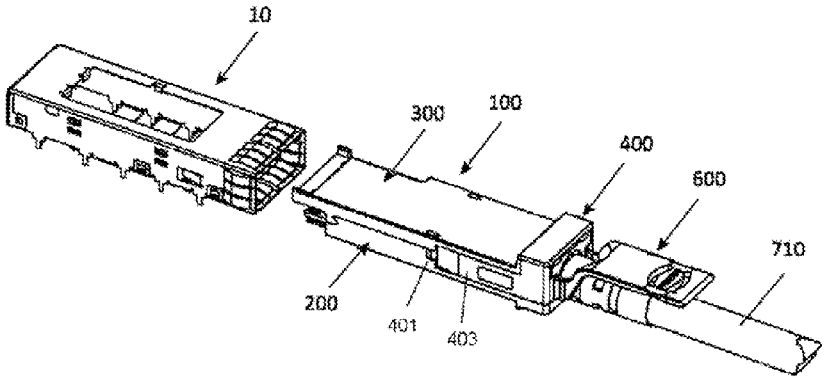

| | | |
|---|---|---|
| CN | 101552407 | 10/2009 |
| CN | 100585962 | 1/2010 |
| CN | 1809772 | 9/2010 |
| JP | 31426588 | 6/2008 |

* cited by examiner

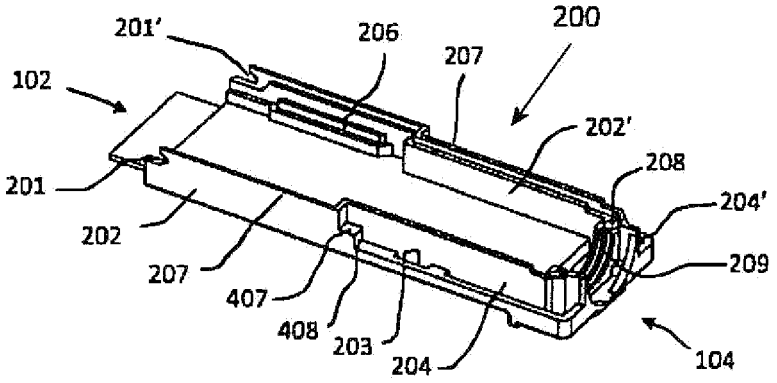
FIG. 3
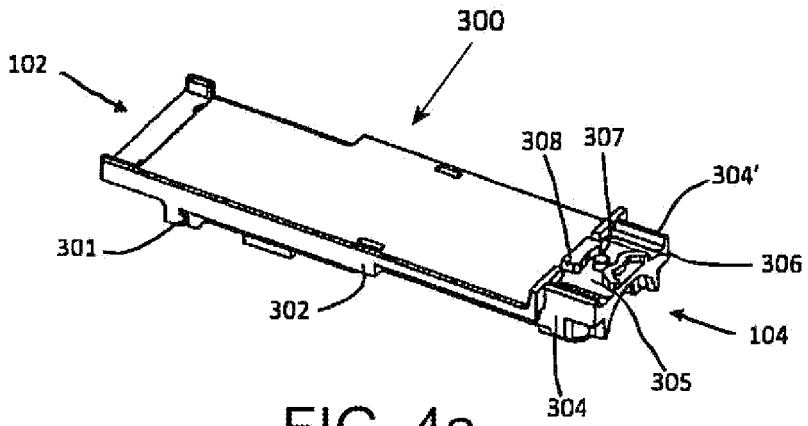
FIG. 4a
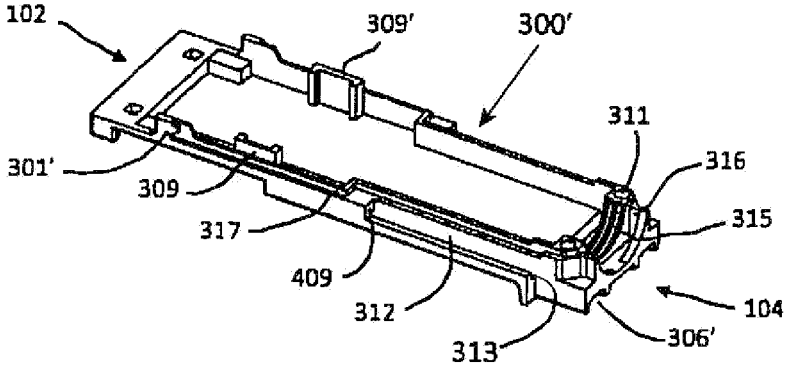
FI.G 4b

LOCKING APPARATUS FOR ELECTRICAL PLUG-TYPE CONNECTORS

This is a national stage of PCT/CN11/078442 filed Aug. 16, 2011 and published in English, which hereby incorporated by reference.

DESCRIPTION

The invention relates to a locking apparatus for an electrical plug-type connector, said plug-type connector being formed from a two-part housing with a cable connection side for electrical cables and a plug-in side formed from a printed circuit board and having electrical contacts, for making direct contact with a mating plug with the electrical contacts thereof, the plug-type connector being forcibly locked when plugged with the mating plug.

Such an electrical plug-type connector, which is also referred to as a QSFP plug-type connector, is required for transmitting signals at high bit rates, as required in Ethernet, for example. Such plug-type connectors are designed for twin-axial copper lines and also for optical waveguides and are used, for example, in a computer center or a switching center for connecting switches and computer units installed in switchgear cabinets to one another.

PRIOR ART

U.S. Pat. No. 7,699,641 B2 has disclosed an electrical plug-type connector module with an unlocking mechanism, with locking with respect to a mating plug taking place by means of two springs, which are arranged on two side walls of the plug-type connector module and which encounter the locking mechanism.

PROBLEM

The invention is therefore based on the problem of equipping a QSFP plug-type connector with an unproblematic locking and unlocking device and of presenting said QSFP plug-type connector in such a way that it can be manipulated easily.

This problem is solved by virtue of the fact that the two-part housing comprises a base housing and a housing upper part, within which a displaceable locking device is arranged, that the locking device has two sliding posts, on which a torsion spring acts, said torsion spring having two spring limbs and bringing about forced locking, acting in the axial direction, with the mating plug, and that the locking is released with an axially reversible movement counter to the spring action.

Advantageous configurations of the invention are specified in the dependent claims.

The invention relates to a shielded, electrical plug-type connector for high-frequency data transmissions using gigabit Ethernet technology. These plug-type connectors are extremely slim, with optical fibers and also copper wires being provided as transmission medium. The version described here uses passive copper lines which have the advantage over the fiberoptic variants of a lower current consumption.

The plug-in side of these so-called QSFP (QSFP=Quad Small Form-factor Pluggable) plug-type connectors has a pluggable printed circuit board, for making contact with corresponding contacts of a mating plug.

The plug-type connector housings are metallically shielding and are equipped with an unlocking mechanism, which can be actuated by means of a pull lug provided on the cable connection side.

In this case, the configuration and dimensions of the plug-in side of the plug-type connector housings are predetermined as standard. Such a plug-type connector is connected to a so-called cage, namely a cage-like, shielding mating plug, which is generally constructed in turn within a housing for switches, routers or bus adapters, i.e. in equipment in the Ethernet sector, directly on printed circuit boards, wherein the plug-type connectors can be inserted into corresponding openings in the housing and are forcibly latched with the mating plug there during insertion.

In addition, a spring-loaded locking mechanism with a pull lug for unlocking from the mating plug is provided. In this case, it is particularly advantageous that the locking device is arranged in the interior of the plug housing, in contrast to the prior art, with the result that parts of the locking mechanism which would otherwise be on the outside cannot be bent or damaged.

No further details are given in relation to the cable tie between the individual signal wires since this appears to be of no further relevance here. Mention is merely made of the fact that the individual signal wires are arranged in such a way as to be combined and potted as a block and so as to make contact with the printed circuit board. In this case, the contact tracks protruding on the plug-in side on the printed circuit board touch corresponding electric contacts of a mating plug.

The plug-type connector, which in this case is formed in two parts from a base housing and an upper housing and has a printed circuit board arranged in the interior for signal transmission, is advantageously hooked in by means of a mechanism formed on its plug-in side, assembled and screwed by means of two screws.

In this case, it has proven to be advantageous to use a torsion spring, by means of which the locking device initially performs a forced locking when the plug-type connector is plugged together with the mating plug.

For this purpose, the torsion spring is held in a separate spring chamber in the upper housing on a rotary journal, with the result that the spring limbs of the spring are initially directed at an angle towards the outer walls of the housing.

The locking device arranged within the two housing parts has two sliding posts, which each reach into the spring chamber in the upper housing through a slot. In this case, the spring limbs act on these sliding posts in such a way that the locking device is continuously pressed in the plug-in direction, and therefore is forcibly latched with the mating plug when the plugging operation of the plug-type connector is complete.

With a pulling movement on the pull lug in the opposite direction to the plug-in direction, the locking is released and the plug-type connector can be removed from the mating plug.

The locking device has two sliding arms with which it is guided axially within a corresponding recess in the side walls, advantageously in a tongue-and-groove guide, in sliding fashion between the two housings.

EXEMPLARY EMBODIMENT

Figure 2:
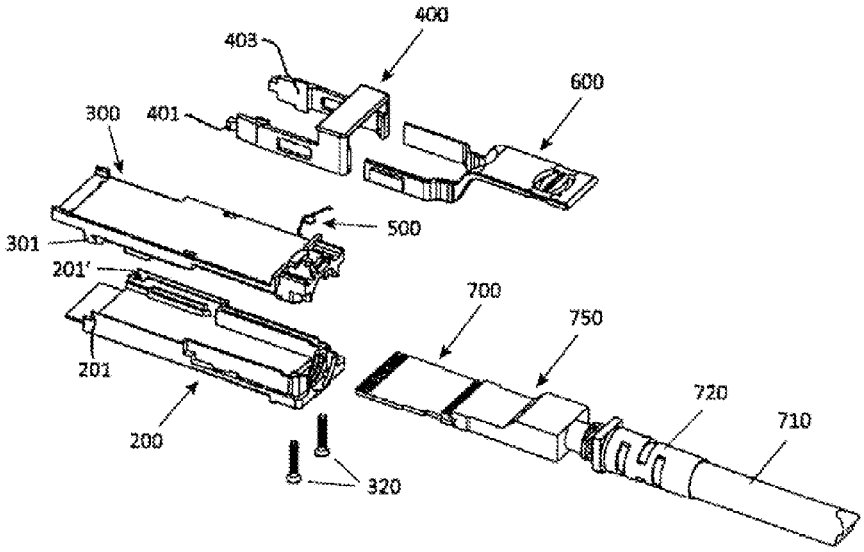
Figure 5A:
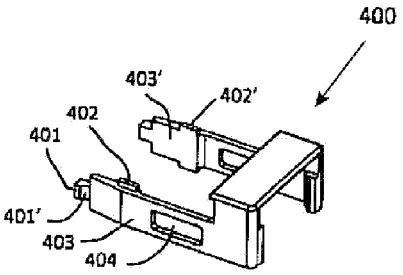
Figure 5B:
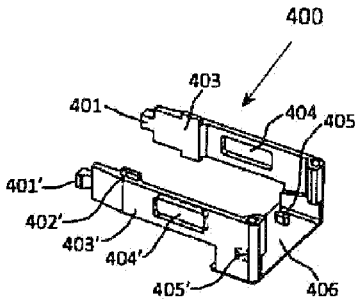
Figure 6:
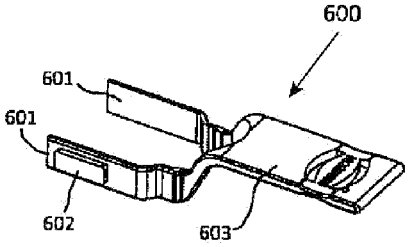
Figure 7:
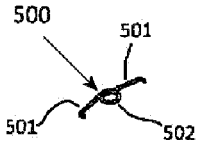
Figure 8:
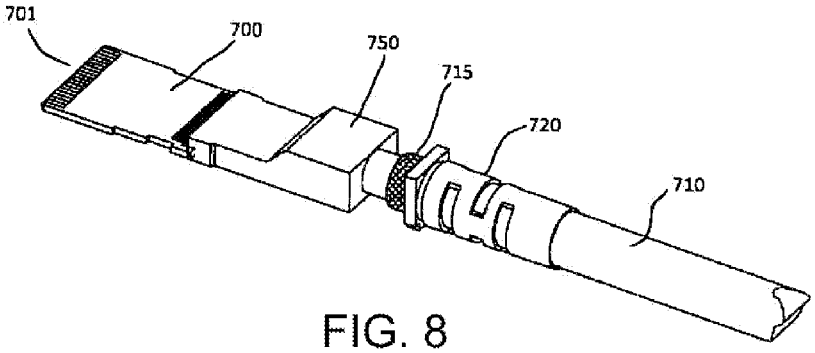

An exemplary embodiment of the invention is illustrated in the drawing and will be explained in more detail below. In the drawing:

FIG. 1 shows a plug-type connector according to the invention with a mating plug, FIG. 2 shows an exploded illustration of the plug-type connectors, FIG. 3 shows an individual base housing, FIG. 4*a* shows an individual upper housing from the outside, FIG. 4*b* shows an individual upper housing from the inside, FIG. 5*a* shows an unlocking device containing the plug-type connector, FIG. 5*b* shows the unlocking device shown in FIG. 5*a*, rotated through 180°, FIG. 6 shows a pull lug provided for unlocking, FIG. 7 shows a torsion spring, and FIG. 8 shows a schematic view of the cable tie in the plug-type connector.

FIG. 1 shows an electrical plug-type connector 100 according to the invention and a cage-like mating plug 10 provided therefor. The plug-type connector 100 is formed from two housing halves, namely a base housing 200 and an upper housing 300, which each have a plug-in side 102 and a connection side 104.

An unlocking device 400, which can be displaced through a certain axial range by means of a pull lug 600, is arranged within the two housing parts.

In this case, the pull lug 600 can be inserted into the locking device 400 on both sides (in this case at the top or at the bottom) of the data cable 710, which has been inserted into the plug-type connector, depending on the application case.

FIG. 2 shows an exploded illustration of an overview of the individual parts belonging to the plug-type connector.

Said figure firstly shows the base housing 200 with the upper housing 300 shown above this, with a plug-in printed circuit board 700 with a connecting conductor block 750 attached thereto and a data cable 710 as well as strain relief 720 surrounding the data cable being inserted between said housings. In the upper housing 300, a torsion spring 500 has been inserted in a spring chamber 305.

Furthermore, an unlocking device 400 with the pull tab 600 is shown.

The base housing 200 is illustrated in more detail in FIG. 3 and has a half-open housing with two side walls 202, 202' and a strain relief holder 209, which is integrally formed on the cable connection side and an open plug-in side 102.

A step-like formation 206 is provided on the inside of the side walls 202, 202' in the front region of the base housing 200, namely the region pointing towards the plug-in side, with the plug-in printed circuit board 700 resting on said step-like formation when said plug-in printed circuit board is inserted into the plug-type connector 100, while two supports 309, 309' are provided in the upper housing 300, said supports fixing the plug-in printed circuit board 700 from the other side. The fixing of the plug-in printed circuit board on the plug-in side 102 is important because contact is made with the mating plug 10 using the electrical contacts 701 located on said plug-in printed circuit board.

In order to provide an EMC-proof housing, stepped shoulders 207, 317 are provided on the edges of the side walls 202, 202' and also on the edges of the side walls 302, 302' of the upper housing 300, said shoulders engaging one inside the other when the two housing parts 200, 300 are fitted, so as to produce a type of labyrinth seal.

FIGS. 4*a* and 4*b* show the upper housing 300, with the inside of the upper housing being denoted by the reference symbol 300'. The outside of the upper housing, with the reference symbol 300, is illustrated, with the plug-in side 102 and the cable connection side 104.

A spring chamber 305 is integrated on the cable connection side 104 in FIG. 4*a*, with a torsion spring 500 being fixed in said spring chamber by means of a guiding post 307.

For this purpose, the torsion spring 500 which is illustrated in enlarged form in FIG. 7 has two spring legs 501, which are connected to one another via a central rotary loop 502.

The ends of the spring legs have only a restricted amount of play within the spring chambers, with said ends preferably being pressed in each case against the outer wall 304, 304'.

Next to the outer walls 304, 304', guide slots 306 are let into the spring chamber, with sliding posts 405 of the unlocking device 400 being guided displaceably in said guide slots.

The unlocking device 400 is shown in FIGS. 5*a* and 5*b*, with the unlocking device in FIG. 5*b* being illustrated such that it is rotated through 180° with respect to that shown in FIG. 5*a*.

In this case, two sliding arms 403, 403' are connected to one another in the form of a U by a central part 406, the sliding arms 403, 403' being connected so as to be perpendicular to one another and integrally with the edges and the central part 406 arranged horizontally above this.

In the central region of the sliding arms 403, 403', on both sides on the edges of the guide rails 402, 402' are integrally formed, said guide rails ensuring secure guidance of the sliding element 400 in recesses on both sides on the narrow sides of the plug-type connector 100.

In each case unlocking elements 401 are integrally formed on the free ends of the sliding arms 403, 403', said unlocking elements being provided with an unlocking bevel 401'.

The unlocking element 401 is arranged in a cutout 407 as an extension of the longitudinal recess 204 in the side wall 202 of the base element 200, whereas the latching edges 408 and 409 are provided in front of the cutout 407 in the longitudinal recess 204 of the base housing 200 and the longitudinal recess 312 of the upper housing, with a locking hook of the mating plug 10 latching behind said latching edges. When the unlocking device 400 is drawn back, the unlocking bevel 401' of the unlocking hook 401 hits the locking hook of the mating plug 10 (not shown here) and withdraws it from the cutout 407.

Furthermore, the central part 406 has two sliding posts 405, which are parallel to one another and are perpendicular to the plane and can slide along, again within the spring chamber 305, in the guide slots 306 provided there and, from the spring legs 501 acting thereon of the torsion spring 500, press the unlocking device 400 continuously in the plug-in direction of the electrical plug-type connector 100. This results in forced locking of the locking hook in and with the mating plug.

The pull tab 600 with the actual tab 603 for unlocking the plug-type connector 100 from the mating plug 10 is shown in FIG. 6.

The connection between the locking device 400 and the pull tab 600 is performed by in each case two fastening cams 602 on the holding arms 601 of the pull lug, said fastening cams latching into correspondingly shaped fastening openings 404, 404' in the sliding arms 403, 403' of the locking device.

FIG. 7 once again shows the torsion spring 500 separately with its two spring legs 501, which are bent back to the side out of a rotary loop 502 in the center.

As shown in FIG. 8, with the plug-side contacts 701 for making contact with the mating plug are arranged on a printed circuit board 700, which is arranged in the front plug-in region of the plug-type connector 100, said contacts being connected to the individual signal conductors of the data cable 710, which is supplied to the cable connection side 104, and initially to conductor tracks on the printed circuit board 700. In this case, the signal conductors not shown in any more detail here are potted by means of a curing compound, with the result that a type of block 750 is produced which can be inserted with a precise fit into the two housing parts 200, 300.

On the cable connection side 104, the data cable 710 is held, towards the outside, by means of the strain relief 720, which is likewise fixed within the two housing parts 200, 300 within a recess 316, while the cable shield 715 with the cable fixing 209 ensures electrical contact between the cable shield and the metallic housing of the plug-type connector 100 in the interior of the two housings 200, 300.

On the plug-in side, the two housing parts have an open latch-in mechanism, with both parts shaped correspondingly to one another, comprising a hook 301, 301' on the upper housing 300, said hook latching into a recess 201, 201' in the base housing 200, with the housing parts initially being hooked with respect to one another by means of said hook, then being assembled and finally being fixed with respect to one another using two screws 320.

LIST OF REFERENCE SYMBOLS

Electrical plug-type connector
10 Mating plug
100 Electrical plug-type connector
102 Plug-in side
104 Cable connection side
200 Base housing
201, 201' Recess left-right for 301
202, 202' Side wall, bottom
203 Sliding groove, bottom for 402
204 Lower side recess for 400
205 Guide slot for 400
206 Supporting edge for printed circuit board
207 Labyrinth seal, groove
208 Screw holes
209 Cable fixing means
300 Upper housing 1 (outside)
301, 301' Hook for recess 1-r 201
302 Side wall, top
303
304, 304' Outer wall of spring chamber
305 Spring chamber
306 Guide slot for 405
307 guiding post
308 Slot for spring tool
309, 309' Support for printed circuit board
300' Upper housing 2 (inside)
311 Screw-type bore
312 Sliding region for unlocking
313 Sliding groove at top for 402
314 Upper lateral recess for 400
315 Cable fastening means
316 Recess for strain relief
317 Opposing labyrinth seal, spring
320 Screws
400 Unlocking device
401 Unlocking hook
401' Unlocking bevel
402, 402' Guide rail
403, 403' Sliding arm
404, 404' Openings for fastening cams
405 Sliding posts
406 Central part, connection
407 Cutout for unlocking hook 401
408 Latching edge in 200 for ext. locking hook
409 Latching edge in 300 for ext. locking hook
500 Torsion spring
501 Spring leg
502 Rotary loop
600 Pull lug
601 Holding arms
602 Fastening cams in 404
603 (Lug)pull tab
700 Plug-in printed circuit board (printed circuit board)
701 Plug-in side contacts
710 Data cable
715 Shield
720 strain relief
750 Connecting conductor block, in contact/enveloped

The invention claimed is:

1. A locking apparatus for an electrical plug-type connector (100), said plug-type connector being formed from a two-part housing (200, 300) with a cable connection side (104) for electrical cables (710) and a plug-in side (102) formed from a printed circuit board (700) and having electrical contacts (701), for making direct contact with a mating plug (10) with the electrical contacts thereof, the plug-type connector (100) being forcibly locked when plugged with the mating plug (10), characterized in that the two-part housing comprises a base housing (200) and a housing upper part (300), within which a displaceable unlocking device (400) is arranged, in that the unlocking device (400) has two sliding posts (405), on which a torsion spring (500), connected to the housing, upper part. acts, said torsion spring having two spring legs (501) and bringing about forced locking, acting in the axial direction, with the mating plug (10), and in that the locking is released with an axially reversible movement counter to the spring action wherein said torsion spring (500) has a rotary loop (502) and is held in a separate spring chamber (305) within the housing upper part (300) by means of a guiding post (307), located within the housing upper part and aligned perpendicularly in the spring chamber (305), said rotary loop encompasses said guiding post, wherein said two spring legs (501) of the torsion spring (500) exert a force acting axially in the sliding direction on said sliding posts (405) of the unlocking device (400) which reach into the spring chamber (305) of the housing upper part, and wherein said unlocking device (400) has two sliding arms (403), which are arranged in axially displaceable fashion within a recess (204, 312) in the side walls (202, 302) of the plug-type connector (100), and wherein said sliding posts (405) are integrally formed perpendicularly within a central part (406) between the sliding arms (403) of the unlocking device.

2. The locking apparatus as claimed in claim 1, characterized in that the sliding arms (403, 403') have fastening openings (404) for a connection by means of fastening cams (602) with respect to a pull tab (600) in order to perform unlocking of the plug-type connector (100) from the mating plug (10).

3. The locking apparatus as claimed in claim 1, characterized in that contact is made with the individual conductors (750) supplied by means of a data cable (710) on the printed circuit board (700) and said individual conductors are enveloped by means of a suitable potting compound and can be inserted as a block with a precise fit between the base housing (200) and the upper housing (300).

4. The locking apparatus as claimed in claim 1, characterized in that the two housing parts (200, 300) are assembled by means of an open latch-in function, formed from hooks (301, 301') which engage in recesses (201, 201') on both sides of the plug-in side (102) and can be fixed to one another by means of two screws (320) close to the cable connection side (104).

* * * * *